US011959710B2

(12) United States Patent
Sus et al.

(10) Patent No.: US 11,959,710 B2
(45) Date of Patent: Apr. 16, 2024

(54) HEAT EXCHANGER WITH REINFORCING MEANS

(71) Applicant: Valeo Autosystemy Sp. z o.o., Skawina (PL)

(72) Inventors: Pawel Sus, Bietigheim-Bissingen (DE); Mateusz Kaczmarczyk, Skawina (PL); Tomasz Wator, Skawina (PL); Karol Pokrywinski, Skawina (PL)

(73) Assignee: VALEO AUTOSYSTEMY SP. Z O.O, Skawina (PL)

( * ) Notice: Subject to any disclaimer, the term of this patent is extended or adjusted under 35 U.S.C. 154(b) by 778 days.

(21) Appl. No.: 16/638,555

(22) PCT Filed: Aug. 14, 2018

(86) PCT No.: PCT/EP2018/072012
§ 371 (c)(1),
(2) Date: Feb. 12, 2020

(87) PCT Pub. No.: WO2019/034646
PCT Pub. Date: Feb. 21, 2019

(65) Prior Publication Data

US 2020/0217601 A1 Jul. 9, 2020

(30) Foreign Application Priority Data

Aug. 17, 2017 (EP) ..... 17461589

(51) Int. Cl.
*F28F 9/00* (2006.01)
*F28D 9/00* (2006.01)
*F28F 9/02* (2006.01)

(52) U.S. Cl.
CPC ..... *F28F 9/0246* (2013.01); *F28D 9/005* (2013.01); *F28F 2225/08* (2013.01)

(58) Field of Classification Search
CPC ..... F28F 9/0246; F28F 9/013; F28F 9/0248; F28F 9/182; F28F 9/185; F28F 2225/08; F28D 9/005
See application file for complete search history.

(56) References Cited

U.S. PATENT DOCUMENTS 5,297,823 A * 3/1994 Dubost ..... F28F 9/0246 285/308
5,538,076 A * 7/1996 Nishida ..... F28F 9/0248 165/76

(Continued)

FOREIGN PATENT DOCUMENTS

CN 1884960 A 12/2006
CN 105659050 A 6/2016

(Continued)

OTHER PUBLICATIONS

International Search Report and Written Opinion corresponding to International Patent Application No. PCT/EP2018/072012, dated Oct. 31, 2018 (8 pages).

(Continued)

*Primary Examiner* — Travis Ruby
(74) *Attorney, Agent, or Firm* — Osha Bergman Watanabe & Burton LLP

(57) ABSTRACT

A heat exchanger for vehicle arranged to allow an internal circulation of at least one fluid, comprising at least a heat exchanger bundle and at least a duct (10) at least partially outside the heat exchanger bundle, the duct (10) penetrating into the heat exchanger bundle by a hole arranged in a terminal plate (8) of the heat exchanger bundle, the duct (10) comprising at least a collar (42) lining the hole, characterized in that the heat exchanger comprises a reinforcing mean (20) in touch with the collar (42) of the duct (10) and with the terminal plate (8) of the heat exchanger bundle.

14 Claims, 4 Drawing Sheets

(56) References Cited

U.S. PATENT DOCUMENTS

Figure 1:
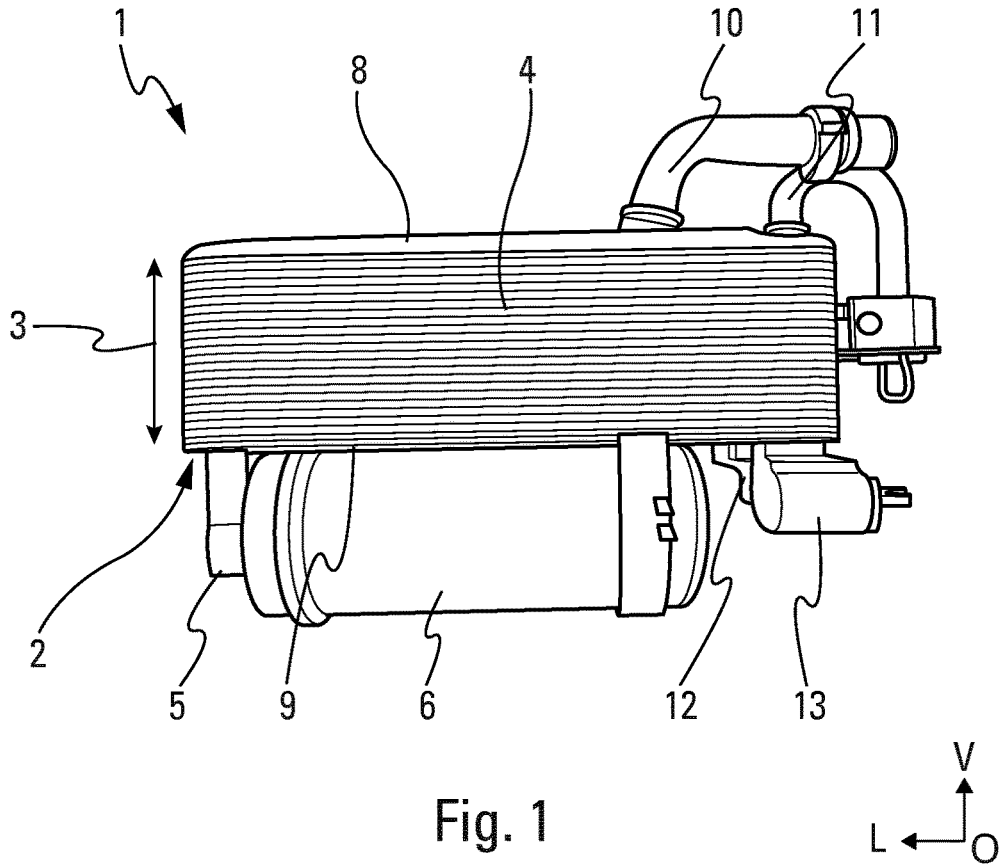

| | | | | | |
|---|---|---|---|---|---|
| 5,975,193 | A * | 11/1999 | Tokita | F28F 9/0246 | 165/178 |
| 2006/0278378 | A1* | 12/2006 | Okura | F28D 9/0043 | 165/140 |
| 2007/0000639 | A1* | 1/2007 | Ozawa | F28F 9/0248 | 165/41 |
| 2018/0299054 | A1* | 10/2018 | Person | F16L 37/1225 | |

FOREIGN PATENT DOCUMENTS

| | | | |
|---|---|---|---|
| DE | 19805439 | A1 | 8/1999 |
| DE | 19805439 | B4 | 6/2005 |
| EP | 1065463 | A2 | 1/2001 |
| EP | 1541955 | A2 | 6/2005 |
| EP | 1739380 | A1 | 1/2007 |

OTHER PUBLICATIONS

First Office Action in corresponding Chinese Application No. 201880064070.X, dated Mar. 5, 2021 (11 pages).

* cited by examiner

HEAT EXCHANGER WITH REINFORCING MEANS

The present invention relates to the field of heat exchangers, especially adapted to equip an air conditioning circuit of motor vehicle or to cool down any component of a vehicle.

Heat exchangers which equip air conditioning circuit of motor vehicle are organized to allow neighboring circulation into two spaces separated of two different fluids, in such a way to realize a heat exchange between the fluids without mixing them. A kind of heat exchanger used in the motor field is the plate-type heat exchanger, such heat exchanger being made by a pile of plates brazed between them and organized to define spaces where the fluids circulate.

Inside heat exchangers and thermodynamic circuits which are linked to these heat exchangers, fluids circulate with variable pressure, often high, about twenty bars. These high pressures, and their variation, apply important efforts on the heat exchanger components and on the thermodynamic circuit components, and especially the admission and evacuation fluid pipes. In addition to this efforts, some vibrations caused by movement of the vehicle are present, all this efforts and vibrations could, at the end, cause damages to the heat exchange, raising the necessity of maintenance for the heat exchanger.

Some solutions have been brought to solve this problem, for example with the augmentation of the wall thickness of the heat exchanger or the pipes. But, those solutions are not satisfactory because this augmentation of the wall thickness limits the fluids circulation and increases the production cost of a heat exchanger.

The invention aim at proposing a unit that resists to the rise of pressure inside the heat exchangers, and consequently to increase heat exchangers' lifespan without the drawbacks listed above.

The object of this invention is a heat exchanger for vehicle arranged to allow an internal circulation of at least one fluid, comprising at least a heat exchanger bundle and at least a duct at least partially outside the heat exchanger bundle, the duct penetrating into the heat exchanger bundle by a hole arranged in a terminal plate of the heat exchanger bundle, the duct comprising at least a collar lining the hole, characterized in that the heat exchanger comprises a reinforcing mean in touch with the collar of the duct and with the terminal plate of the heat exchanger bundle.

Heat exchanger according to the invention comprises optionally at least one of the following characteristics, taken alone or in combination:

- the pipe is at least partially outside of the heat exchanger bundle. This means that a part of the pipe extends outside of a zone where heat exchanges take place between circulating fluids inside the heat exchanger,
- the collar borders the hole made in the terminal plate. The collar leans on a part of the terminal plate which delimits the hole. More specifically, the part from the terminal plate where the collar has physical contact comprises a neck which extends all around the hole. This neck may delimit the hole,
- the reinforcing mean is organized to transfer at least a part of forces applied on the pipe to the heat exchanger. For example, the reinforcing mean is organized to increase contact areas between the pipe and the heat exchanger,
- the reinforcing mean has an annular form, and stretches out all around the pipe. In an example, such reinforcing mean is a ring that can be circularly closed or opened. Peripheral edge of such a ring may comprise indentations,

- the reinforcing mean comprises a lower surface in touch with the terminal plate of the heat exchanger bundle,
- the reinforcing mean comprises at least a first flat section and a second flat section, the first flat section being at least in touch with the collar the duct, the second flat section being at least in contact of the terminal plate. The first flat section is the portion of the reinforcing mean arranged near the duct, the second flat section being away from the duct with regard to the first flat section,
- the first flat section extends in a first plan, which is parallel to the second plan in which extends the second flat section. The first plan is essentially parallel to the second plan, taking into account tolerances of manufacturing of the reinforcing mean according to the invention. These tolerances may go till an angle of 3°, but still being considered as parallel,
- in an alternative, the first flat section and the second flat section extend in inclined plans. Said in other words, these plans are secant one another,
- the second flat section includes at least two radial extensions separated by at least an interval. The radial extensions are regularly distributed around the reinforcing mean. These radial extensions are going outside the reinforcing mean,
- the radial extensions are configured to increase the contact area of the reinforcing mean on the heat exchanger. The radial extensions are more particularly adapted to get in touch with the terminal plate of the heat exchanger, whatever is its configuration. By this way, the reinforcing mean is able to be used on a terminal plate that comprises at least a relief, radial extensions coming to marry the forms of the relief,
- the interval form a passage between a chamber delimited by the terminal plate, the collar and the reinforcing mean, and an outside environment the heat exchanger. This passage is configured to allow the evacuation of gases appearing during the manufacturing of the heat exchanger according to the invention, this manufacturing being made in particular by brazing,
- the first flat section is interposed between the collar and a neck which surrounds the hole of the terminal plate,
- the reinforcing mean is formed of a flange delimited by a upper surface and a lower surface. The upper surface is the surface of the flange turned outside the heat exchanger, which is in a direction tending to go away from the heat exchanger. The lower surface is the surface of the flange facing the heat exchanger, which is in a direction which tends to get closer to the heat exchanger. The lower surface and the upper surface are opposed one another,
- the reinforcing mean includes a first lower surface and the second lower surface. More particularly, the above identified lower surface of the reinforcing mean includes the first lower surface and the second lower surface,
- the first lower surface is contacting with the neck of the terminal plate, the second lower surface being in touch with a portion of the terminal plate at least partially, optionally totally, surrounding the neck,
- the first lower surface is contacting with the neck of the terminal plate, the first lower surface is in touch with the collar of the duct,
- the upper surface of the reinforcing mean is in touch with the collar of the duct,
- the neck of the terminal plate includes an inner face, the duct being in contact to the inner face of the neck, the reinforcing mean is arranged outside of the heat exchanger. More particularly, the reinforcing mean is completely outside of the bundle, the heat exchanger bundle is ended with a first terminal plate and with a second terminal plate, the reinforcing mean being completely arranged outside of a space delimited by the first terminal plate and by the second terminal plate, the reinforcing mean is bound in solidarity to the duct and to the heat exchanger by a metal of contribution. The reinforcing mean is brazed to the heat exchanger, The heat exchanger of the invention is having a first internal path adapted to a refrigerant fluid and a second internal path adapted to a liquid coolant. In other words, said heat exchanger may be called a fluid-cooled condenser.

The invention also concerns a vehicle equipped with a heat exchanger such as described above.

Figure 2:
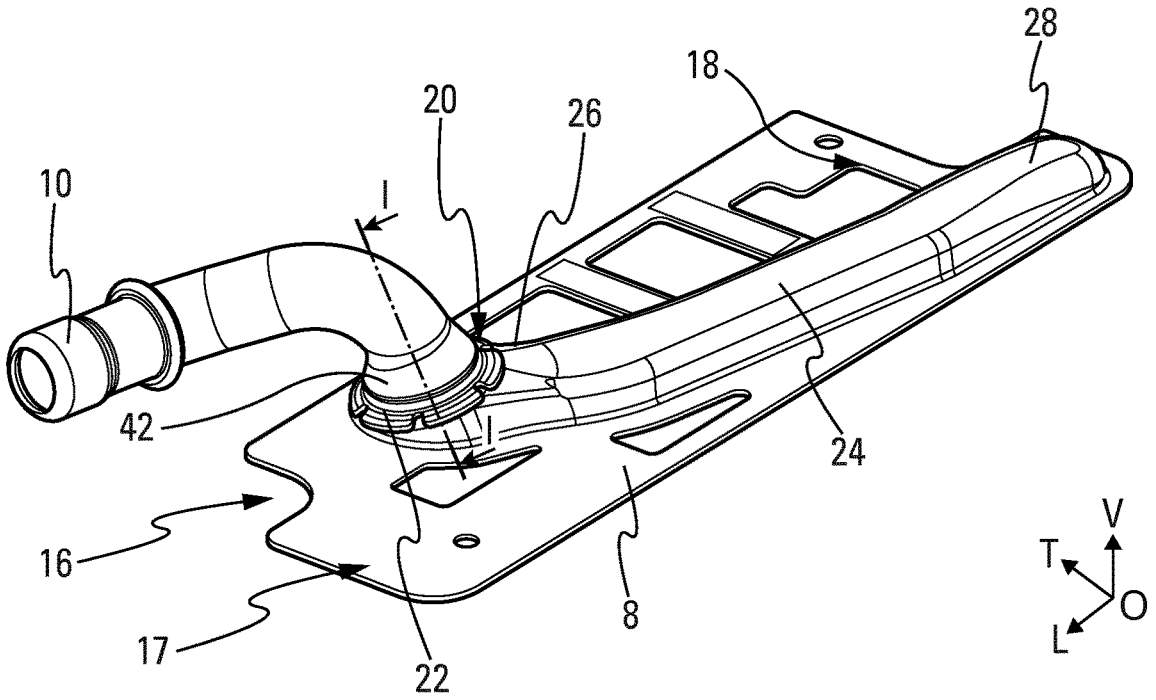
Figure 3:
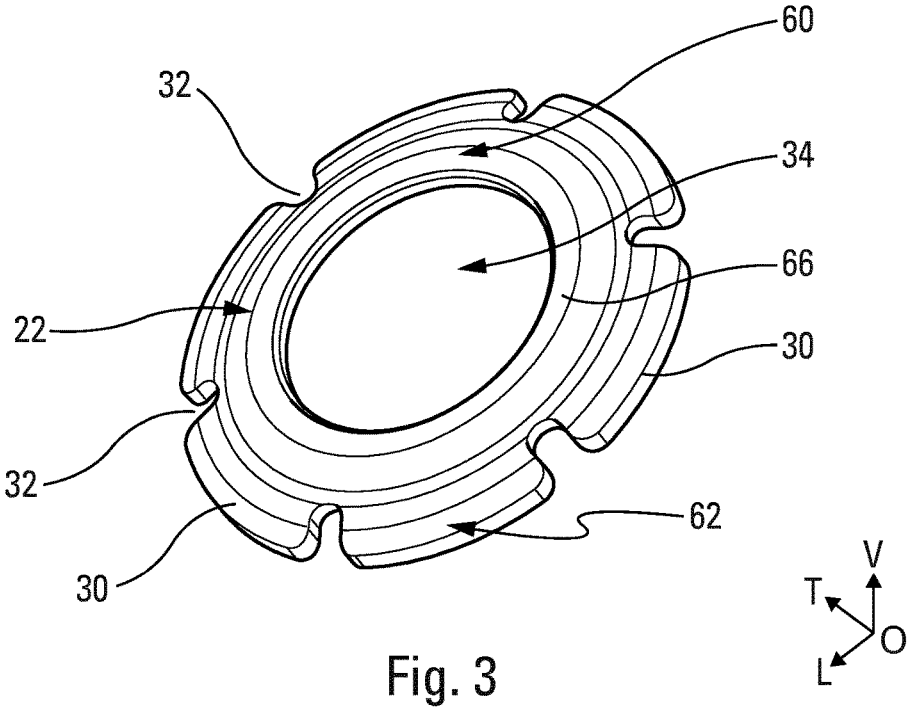
Figure 4:
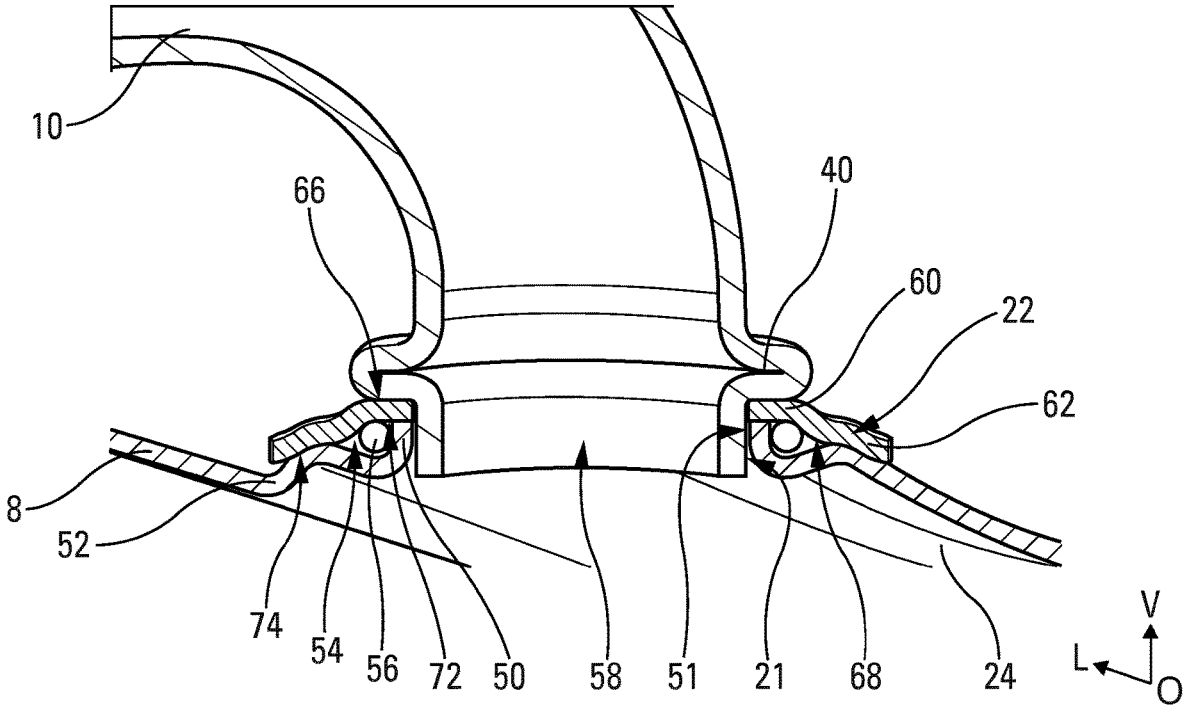
Figure 5:
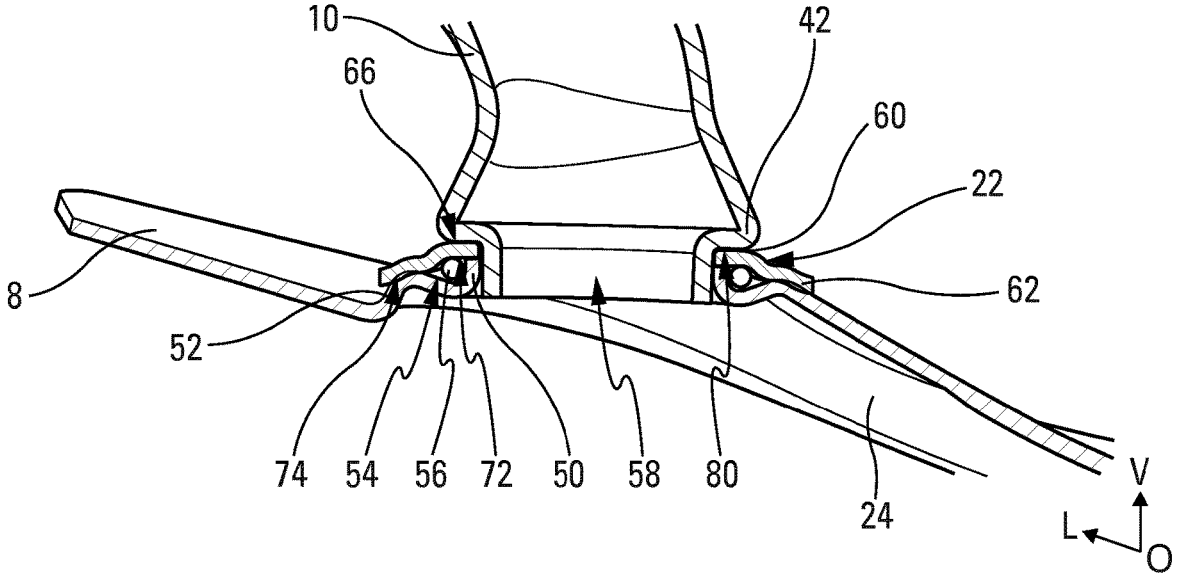
Figure 6:
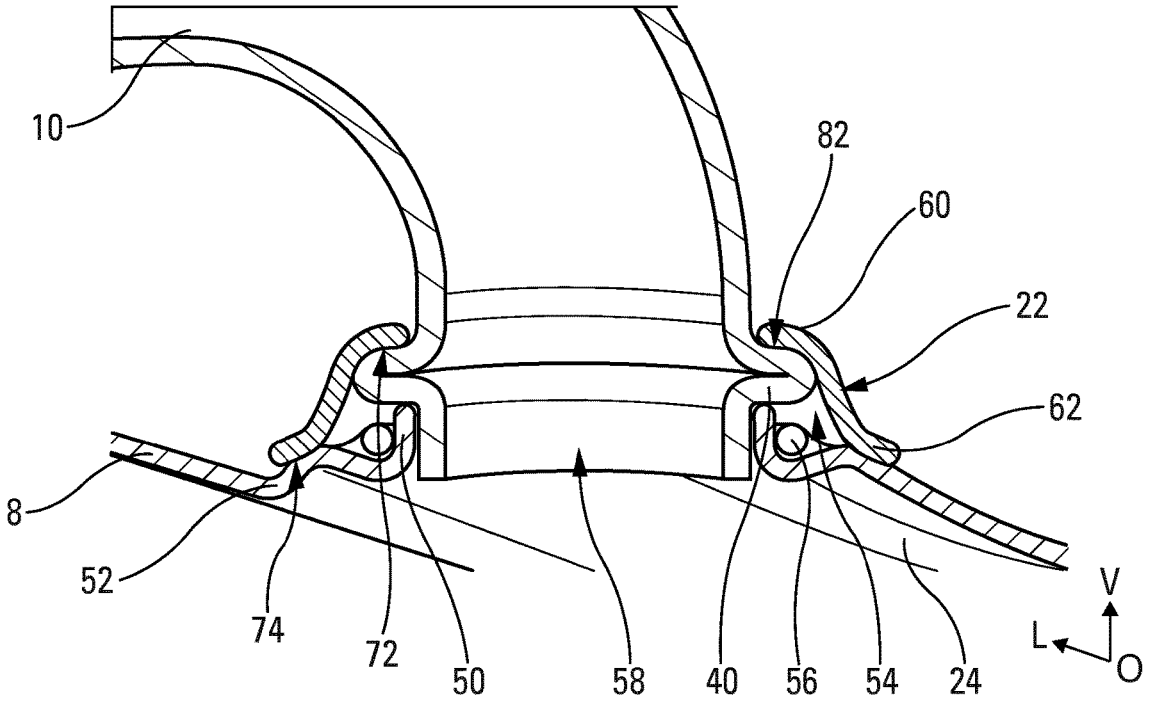
Figure 7:
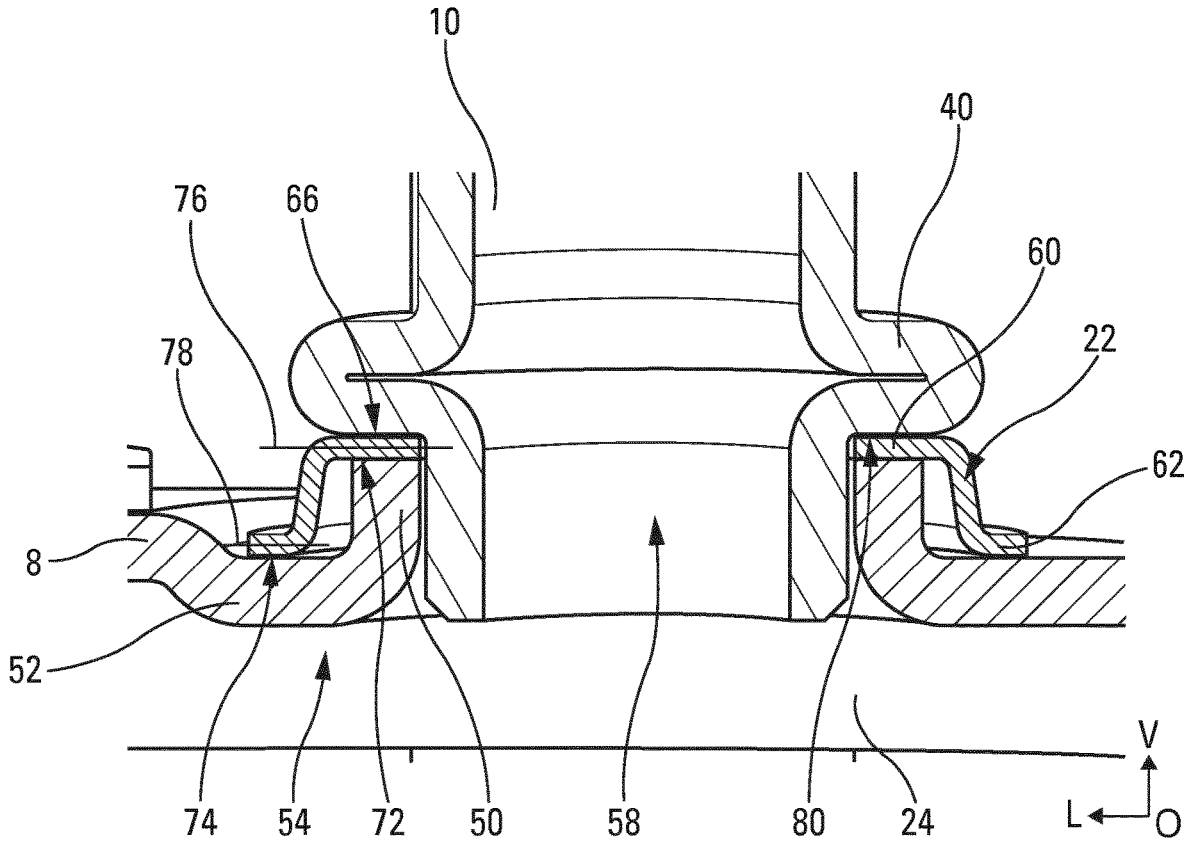

Other characteristics, details and advantages of the invention will stand out more clearly in the reading of the description given below for information purposes in connection with drawings in which:

the FIG. 1 is a view in perspective of a heat exchanger according to the invention, the FIG. 2 is a view in perspective of the terminal plate, the duct and the reinforcing mean according to the invention, the FIG. 3 is a view in perspective of the reinforcing mean of the invention, the FIG. 4 is a view in section of a first variant of the invention, according to plan I-I shown on FIG. 2, the FIG. 5 is a view in section of the second variant of the invention, according to the plan I-I shown on FIG. 2, the FIG. 6 is a view in section of the third variant of the invention, according to the plan I-I shown on FIG. 2, the FIG. 7 is a view in section of the fourth variant of the invention, according to the plan I-I shown on FIG. 2.

It is necessary to note first of all that figures expose the invention in great detail to implement the invention, the aforementioned figures which can naturally serve to define better the invention if necessary.

During the description, the longitudinal, vertical or transverse, lower, upper, internal or external refer to the orientation of the heat exchanger according to the invention. The longitudinal direction corresponds to the main axis of the heat exchanger in which its biggest dimension extends. The vertical direction corresponding to the sense of pile of tubes forming the bundle of the heat exchanger, the transverse direction being the perpendicular direction of the two other directions. The internal or external directions refer to the heat exchanger, the internal direction indicating the direction tending to get closer to the bundle of heat exchanger, the external directions indicating the directions tending to go away from the bundle of the heat exchanger. The longitudinal, transverse and vertical directions are also visible in a trihedron L, V, T represented on figures.

The FIG. 1 shows in perspective a heat exchanger 1 that supports a separation phase component 6.

The heat exchanger 1 is a component of a refrigerant circuit which equips a vehicle, in particular a motor vehicle. According to the invention, the heat exchanger 1 implements an exchange of heat between a first fluid and second fluid, the first fluid being cooled by the second fluid. In such a configuration, the heat exchanger 1 is used as condenser for a sub-critical or super-critical refrigerant fluid. The second fluid is advantageously a coolant liquid, such as a mixture water-glycol.

The heat exchanger 1 includes a bundle of plates 2 where the exchange of heat between the first fluid and the second fluid takes place. The bundle 2 is globally formed by a pile of plates 4, stacked one onto the other along a direction of pile 3 of these plates 4. The bundle 2 includes in particular a first terminal plate 8 and a second terminal plate 9 which delimits the bundle 2 along the direction of pile 3. Between the first terminal plate 8 and the second terminal plate 9 is arranged the plurality of plates 4 which bounds two different circuits: a first circuit configured to be used by the first fluid and the second circuit configured to be used by the second fluid.

The heat exchanger 1 includes also ways of fluidically connecting these circuits with, on one hand an external circuit of the first fluid and, on the other hand, with an external circuit of the second fluid. The heat exchanger 1 includes a first duct 10 by which the first fluid can enter the heat exchanger 1 and a first conduit 12 by which the first fluid can go out of the heat exchanger 1. This heat exchanger 1 includes another second duct 13 by which the second fluid can enter the bundle 2, as well as a second conduit 11 by which the second fluid can go out of the bundle 2. It shall be noted that the bundle 2 includes a first opening and the second opening used by the second fluid and are in communication with a base 5 interposed fluidly between the heat exchanger 1 and the separation phase component 6, the latter being mechanically carried by the base 5. The base 5 is so a part of the heat exchanger 1, and is arranged in front of the second terminal plate 9.

The FIG. 2 exposes more in detail the first terminal plate 8, in particular its interaction with the duct 10.

The first terminal plate 8 is of a rectangular shape, and presents a cut 16 at a first longitudinal end 17. This cut 16 is configured to allow the insertion in the bundle 2 of the second duct 11. The insertion of the first duct 10 in the first terminal plate 8 is also made in the first longitudinal end 17. The first duct 10 fits into the first terminal plate 8, in particular at the level of a cavity 24 of lengthened form, extending between the first longitudinal end 17 and the second longitudinal end 18 of the first terminal plate 8.

The cavity 24 forms a swelling, of semicircular section, oriented towards the outside of the heat exchanger 1. This cavity 24 extends between a first edge 26 where the first duct 10 fits into the first terminal plate 8, and the second edge 28 was arranged in the second longitudinal end 18. The cavity 24 is arranged in particular to allow the flow of the fluid of the first edge 26, that is starting from the junction of the cavity 24 with the first duct 10, towards the second edge 28, where the fluid can pass by in the bundle 2 of the heat exchanger 1.

The insertion of the first duct 10 in the first terminal plate 8 allows the circulation of the fluid of the first duct 10 in the heat exchanger bundle 2. The first duct 10 is however external of the heat exchanger bundle 2, that is the majority of the first duct 10 extend outside the heat exchanger bundle 2. This insertion is strengthened by a reinforcing mean 20, configured at the interface between the first duct 10 and the first terminal plate 8. The reinforcing mean 20 takes in particular the shape of a flange 22, arranged radially around the first duct 10.

An example of such flange 22 is represented on FIG. 3, for example as a ring which is a closed circular ring or an opened circular ring.

The flange 22 such as illustrated in the FIG. 3 has an annular shape. This flange 22 includes a first flat section 60 and the second flat section 62. With regard to an axis passing by a center of the flange 22, the second flat section 62 is the section the most distant from this axis, the first flat section 60 being arranged between this axis and the second flat section 62.

The flange 22 includes more particularly a concave face and a convex face. The concave face of the flange 22 is a lower surface 68 of the flange 22, the convex face being an upper surface 66 of the flange 22. This measure is more clearly represented on FIGS. 4-7.

Still on FIG. 3, the flange 22 includes a plurality of radial extensions 30 separated by intervals 32. The radial extensions 30 are regularly distributed around the flange 22. Said radial extensions and said intervals form peripheral tooth all around the flange 22. More particularly, the radial extensions 30 and the intervals 32 are arranged on the second flat section 62. The intervals 32 are shaped in the same way, that is to say with "U" shape profile, seen in a perpendicular direction on the upper surface 66 or on the lower surface 68.

The flange 22 includes an opening 34 arranged to allow the insertion of the first duct 10 in the flange 22. The diameter of a part of the flange 22 surrounding the opening 34 is slightly bigger than an outside diameter of the first duct 10, and more particularly the first extremity of the first duct 10 as illustrated in FIGS. 4-7. By slightly bigger, it shall be understood that a bigger diameter allow the insertion without forcing of the first duct 10 in the opening 34 of the flange 22, taking into account possible tolerances of manufacturing, but with a restricting clearance around the first duct 10.

The example of flange 22 given above is not restrictive at all the invention, other forms of flange being possibly used. In particular, a flange 22 including a different number of radial extensions, or even no radial extension radial, is all the same able of strengthening the interaction between the first duct 10 and the first terminal plate 8 and enters consequently within the framework of the invention.

Several examples of arrangement of the first duct 10, of the first terminal plate 8 and of the reinforcing mean 20, illustrated in FIGS. 4 to 7 are now going to been described. As for the example of the flange 22, these examples are given only for illustrative purposes and could not establish the entire invention or limit it in any way.

On the FIG. 4 is illustrated a first embodiment of the invention.

We can observe on this FIG. 4 the first duct 10 inserting in the first terminal plate 8 via a hole 58. The first duct 10 opens in the cavity 24, more particularly at the level of the first edge 26. The hole 58 is lined with a neck 50 of circular form. Taken in the cut according to the plan I-I of FIG. 2, the neck 50 is shaped as a truncated cone in its peak. By fitting into the hole 58, the first duct 10 comes in touch with an inner face 51 of the neck 50. The inner face 51 of the neck 50 corresponds to the face of the neck 50 in front of the hole 58. More particularly, it is an outside face 21 of the first duct 10 that comes in contact with the inner face of the neck 50.

The first duct 10 includes a collar 40. This collar 40 is of a first type, that is to say formed by a fold at 180° of the first duct 10. This arrangement confers on the collar 40 an aspect of annular swelling going out of the outside face 21 of the first duct 10. The collar 40 is configured in particular to fulfill the role of abutment, to limit the penetration of the first duct 10 within the first terminal plate 8 via the hole 58.

The flange 22 is positioned in contact of the first duct 10 and the first terminal plate 8.

On one hand, the flange 22 is more particularly positioned so that its lower surface 68, of concave conformation, is configured against the first terminal plate 8. In this arrangement, the first flat section 60 of the flange 22 is touching the neck 50, whereas the second flat section 62 is touching with a portion 52 surrounding the neck 50.

On the other hand, the flange 22 is located against the first duct 10, around said first duct 10. By this way, the first duct 10 is positioned in the opening 34 of the flange 22. In this arrangement, the upper surface 66 of the flange 22 is in touch with the collar 40 of the first duct 10. In a more specific way, the upper surface 66 is in touch with a lower face 80 of the collar 40, which is the face of the collar 40 in front of the first terminal plate 8. The flange 22 is so pinched between the first duct 10 and the first terminal plate 8.

In this arrangement, the forces and the vibrations supported by the first duct 10 are transferred to the flange 22 by the collar 40, in particular by the lower face 80 of the collar 40, the flange 22 passing on at least partially these forces and vibrations to the first terminal plate 8, in particular to the neck 50 and to the portion 52 surrounding the neck 50, what improves the resistance and the longevity of the assembly.

Peripherally to the neck 50, in the chamber 54, a brazing ring 56 is arranged so as to allow a contribution of metal to attach the first duct 10, the flange 22 and the first terminal plate 8, and so facilitate a step of brazing used during the manufacturing of the heat exchanger 1.

The collar 40 of the first duct 10 can be configured in a different way. In particular, a collar 42 of the second type is illustrated in the FIG. 5, which represents a second embodiment of the invention. The collar 42 of the second type is formed by an extension of the first duct 10, this extension taking the shape of a cone. The flange 22 has an upper surface 66 in touch with a lower face 80 of the collar 42, a first lower surface 72 in contact the neck 50 and a second lower surface 74 in touch with the portion 52 arranged around the neck 50. The other technical features of this second embodiment are similar or identical to the first embodiment as described above. The arrangement of the first terminal plate 8 remains unchanged.

A third embodiment of the invention is illustrated in the FIG. 6.

In this embodiment, the first duct 10 includes a collar 40 identical to the collar exposed in the first embodiment illustrated in the FIG. 4. In this arrangement, the flange 22 is positioned over the collar 40. More particularly, the first lower surface 72 of the flange 22 is positioned in touch with an upper face 82 of the collar 40, that is to say the face of the collar 40 which is opposite to the lower face 80 of the collar 40. Therefore, the chamber 54 has a bigger volume than chambers 54 of the two previous examples of realization.

The second lower surface 74 of the flange 22 is in touch with the portion 52 arranged around the neck 50. Furthermore, because of the modification of position of the flange 22 with regard to the first embodiment, the lower face 80 of the collar 40 is touching, for example via a direct contact, with the neck 50 of the first terminal plate 8.

The third embodiment shares the other structural and functional characteristics of the first embodiment as described in the FIG. 4, in particular the arrangement of the first terminal plate 8 which is the same as in the first or the second embodiment of the invention.

FIG. 7 illustrates the fourth embodiment of the invention. In this mode of realization, the first duct 10 includes a collar 40 having a fold turned at 180°, such as the one described in relation to the FIG. 4. The flange 22 is arranged between the collar 40 and the neck 50, that is the flange 22, and more particularly its first flat section 60 is pinched between the lower face 80 of the collar 40 and the neck 50.

In this embodiment, the first flat section 60 of the flange 22 extends in a third plan 76, the second flat section 62 spreading into a fourth plan 78. The third plan 76 and the fourth plan 78 are parallel one another, leaving tolerances aside. Furthermore, the portion 52 surrounding the neck 50 is flat and parallel simultaneously to the third plan 76 and to the fourth plan 78.

Another difference with regard to the other embodiments is the absence of a brazing ring in the chamber 54. It is nevertheless possible to add such a brazing ring in the chamber 54, as it is also possible to remove the one presents in the other embodiments, without escaping from the scope of the invention.

The configuration and the layout of the first duct 10 and the first terminal plate 8 are identical to those of the first duct 10 and the first terminal plate 8 of the first embodiment or of the third embodiment.

The preceding description clearly illustrate how the invention fulfills its objectives, as laid out in the preamble, and offers in particular to propose a heat exchanger comprising at least a reinforcing mean in touch with a collar of a duct and a terminal plate of a heat exchanger bundle, in order to limit torsion or movement of the duct versus the terminal plate.

Several modifications and improvement might be applied by the person skilled in the art to the heat exchanger as defined above, as long as a reinforcing mean as described above is implemented.

In any case, the invention cannot and should not be limited to the embodiments specifically described in this document, as other embodiments might exist. The invention shall spread to any equivalent mean and any technically operating combination of means.

The invention claimed is:

1. A heat exchanger for vehicle arranged to allow an internal circulation of at least one fluid, the heat exchanger comprising:

at least one heat exchanger bundle;

at least one duct at least partially outside the heat exchanger bundle, the duct penetrating into the heat exchanger bundle by a hole arranged in a terminal plate of the heat exchanger bundle, the duct comprising at least a collar lining the hole; and a reinforcing means in touch with the collar of the duct and with the terminal plate of the heat exchanger bundle, wherein the reinforcing means is of an annular shape and extends all around the duct, wherein the reinforcing means comprises a lower surface that contacts the terminal plate of the heat exchanger bundle and contacts a brazing ring that is disposed, around the hole, between the reinforcing means and the terminal plate of the heat exchanger, wherein the brazing ring, the reinforcing means, and the terminal plate are disposed to form a chamber between the brazing ring, the reinforcing means, and the terminal plate and on an outer periphery of the brazing ring, wherein the terminal plate comprises a neck that extends toward the collar of the duct, and wherein the brazing ring is disposed around the neck.

2. The heat exchanger according to claim 1, in which the reinforcing means comprises at least a first flat section and a second flat section, the first flat section being at least in touch with the collar of the duct, the second flat section being at least in contact of the terminal plate.

3. The heat exchanger according to claim 2, in which the first flat section extends in a first plane, which is parallel to a second plane in which extends the second flat section.

4. The heat exchanger according to claim 2, in which the first flat section and the second flat section extend in inclined planes with respect to a plane of the collar.

5. The heat exchanger according to claim 2, in which the second flat section includes at least two radial extensions separated by at least an interval.

6. The heat exchanger according to claim 5, in which the interval form a passage between the chamber delimited by the terminal plate, the collar and the reinforcing mean, and an outside environment the heat exchanger.

7. The heat exchanger according to claim 2, in which the first flat section is interposed between the collar and the neck which surrounds the hole of the terminal plate.

8. The heat exchanger according to claim 1, in which the reinforcing means is formed by a flange delimited by an upper surface and a lower surface.

9. The heat exchanger according to claim 8, in which the lower surface includes a first lower surface and a second lower surface.

10. The heat exchanger according to claim 9, in which the first lower surface is in touch with the neck of the terminal plate, the second lower surface being in touch with a portion of the terminal plate surrounding at least partially the neck.

11. The heat exchanger according to claim 9, in which the first lower surface is in touch with the neck of the terminal plate, the first lower surface being in touch with the collar of the duct.

12. The heat exchanger according to claim 1, in which the reinforcing mean is connected in common to the duct and to the heat exchanger by a metal contribution.

13. The heat exchanger according to claim 1, having a first internal path adapted to a refrigerant fluid and a second internal path adapted to a liquid coolant.

14. A heat exchanger for vehicle arranged to allow an internal circulation of at least one fluid, the heat exchanger comprising:

at least one heat exchanger bundle comprising a pile of plates stacked onto one another, the pile of plates being delimited by a first terminal plate and a second terminal plate;

at least one duct at least partially outside the heat exchanger bundle, the duct penetrating into the heat exchanger bundle by a hole arranged in one of the terminal plates of the heat exchanger bundle, the duct comprising at least a collar lining the hole; and a reinforcing means in touch with the collar of the duct and with the one of the terminal plates of the heat exchanger bundle, the reinforcing means being able to transfer at least a portion of forces applied on the duct to the heat exchanger by increasing contact areas between the duct and the heat exchanger, wherein the reinforcing means is of an annular shape and extends all around the duct, wherein the reinforcing means comprises a lower surface that contacts the terminal plate of the heat exchanger bundle and contacts a brazing ring that is disposed, around the hole, between the reinforcing means and the terminal plate of the heat exchanger, wherein the brazing ring, the reinforcing means, and the terminal plate are disposed to form a chamber between the brazing ring, the reinforcing means, and the terminal plate and on an outer periphery of the brazing ring, wherein the terminal plate comprises a neck that extends toward the collar of the duct, and wherein the brazing ring is disposed around the neck.

* * * * *